US005412820A

United States Patent [19]

Richards

[11] Patent Number: 5,412,820

[45] Date of Patent: May 9, 1995

[54] INVALID HOIST WITH LATERALLY ADJUSTABLE BASE

[75] Inventor: Derek Richards, Longhope, England

[73] Assignee: Arjo Limited, Gloucester, England

[21] Appl. No.: 253,069

[22] Filed: Jun. 2, 1994

Related U.S. Application Data

[62] Division of Ser. No. 71,385, Jun. 2, 1993, Pat. No. 5,369,821.

[30] Foreign Application Priority Data

Jun. 6, 1992 [GB] United Kingdom ..... 9212055

[51] Int. Cl.[6] ..... A61G 7/14

[52] U.S. Cl. ..... 5/86.1

[58] Field of Search ..... 5/81.1–89.1

[56] References Cited

U.S. PATENT DOCUMENTS 2,595,651 5/1952 Feist ..... 5/86.1
2,821,406 1/1958 Moyer et al. ..... 5/83.1
2,903,238 9/1959 Flandrick ..... 5/83.1
3,203,009 8/1965 Lundberg ..... 5/81.1

FOREIGN PATENT DOCUMENTS 0241096 10/1987 European Pat. Off. ..... 5/86.1

*Primary Examiner*—Alexander Grosz
*Attorney, Agent, or Firm*—Young & Thompson

[57] ABSTRACT

An invalid hoist comprising a chassis having a main support member on which a mast is supported and two side members extending forwardly of the main support member. The side members are swivellable by a power operated device between a first position in which they extend from the main support member in parallel or substantially parallel spaced relationship, and a second position in which they diverge as they extend forwardly from the main support member. The power operated device comprises an electrically powered actuator and a linkage arrangement which ensures that the side members are swivelled in opposite angular directions at equal angular rates of displacement by the actuator.

2 Claims, 6 Drawing Sheets

INVALID HOIST WITH LATERALLY ADJUSTABLE BASE

This application is a division of application Ser. No. 08/071,385, filed Jun. 2, 1993, now U.S. Pat. No. 5,369,821.

BACKGROUND OF THE INVENTION

This invention relates to invalid hoists and more particularly but not exclusively to such hoists for raising infirm and disabled persons from a sitting to a generally standing position.

One such hoist is disclosed in GB 2223477. This known hoist has a lifting member which is pivotally connected to the upper end of a mast and a manually operable mechanical drive mechanism for pivoting the lifting member relative to the mast in order to move a pair of laterally spaced sling attachments points along an arcuate path. These known hoists have proved to be highly successful and are being put to more and more use in hospitals and nursing homes. Indeed, in some cases these hoists are regularly used to perform over fifty lifts per day. As the hoists have been put to more and more use, a need has arisen for an electric hoist which takes away the manual effort required to operate the hoist.

Electric hoists are known but those which include a pivotable lifting member all have an exposed actuator which operates on the lifting member and which detracts from the aesthetic appearance of the hoist and presents trapping points where parts of the body can become trapped and injured.

The present invention in one aspect seeks to provide an invalid hoist which largely overcomes at least some of the drawbacks of known hoists.

SUMMARY OF THE INVENTION

According to one aspect of the present invention there is provided an invalid hoist comprising a mast, a shaft angularly movable relative to the mast about a horizontal or substantially horizontal axis, a lifting member secured to the shaft so as to pivot relative to the mast in response to angular movement of the shaft, a torque arm secured to the shaft at a position which is spaced axially along the shaft from the lifting member and an electrically powered actuator pivotally connected at one end to the torque arm at a position remote from said shaft and pivotally connected at its opposite end with respect to the mast so that operation of the actuator will displace the torque arm to angularly displace the shaft and pivot the lifting member relative to the mast.

The provision of a separate torque arm offset axially from the lifting member allows the torque arm and the electrically powered actuator to be enclosed in a housing thus improving the aesthetic appearance of the hoist and shielding both user and carer from points where parts of the body could become trapped.

Preferably, the lifting member comprises two lifting arms secured to opposite ends of the shaft and the torque arm is secured to the shaft intermediate the ends of the shaft. In this case, the torque arm and actuator can be enclosed in a housing disposed between the two lifting arms.

Alternatively, the lifting member may comprise a single arm which is, preferably, bifurcated at its end secured to the shaft. In this latter case, the torque arm and actuator can be enclosed in a housing disposed within the bifurcated end of the lifting member.

Preferably, a straight line connecting the pivot axis between the actuator and the torque arm to the axis of the shaft is angularly spaced about the axis of the shaft from the general longitudinal extent of the lifting member so as to enable a better leverage to be obtained on the torque arm over the range of movement of the lifting member.

In order to keep the torque arm relatively short and the electrically powered actuator relatively small, a gas spring may be provided to assist the actuator in raising the lifting member. In this case, the gas spring may be arranged alongside the actuator. The gas spring can also be enclosed in a housing together with the torque arm and the actuator.

Preferably, the torque arm comprises two parts connected together for limited pivotable movement relative to one another and switch means are provided which are activated by relative movement of the two parts if the lifting member meets with an obstruction during a lowering operation to cut off power to the actuator.

Conveniently, the hoist is in the form of a standing aid which can be used to raise infirm or disabled persons from a sitting to a generally standing position. In this case, the lifting member preferably comprises two lifting arms which are secured to opposite ends of the shaft and which provide laterally spaced attachment points for the attachment of a body sling at positions remote from the shaft.

Preferably, the hoist also comprises a mobile chassis supporting the mast and also, preferably, foot resting means.

The chassis may comprise a main support member on which the mast is supported and two side members extending forwardly of the main support member, the side members being swivellable relative to the support member so that they can be spread apart to enable the chassis to straddle a chair on which a patient is seated. In this case, the chassis may be provided with power operated means for swivelling the side members relative to the support member, such power operated means preferably comprising an electrically powered actuator and a linkage arrangement which ensures that the two side members are swivelled in opposite angular directions at equal angular rates of displacement by the actuator.

Indeed, the provision of a chassis of this type on any kind of invalid hoist is thought to be novel and, accordingly, in a further aspect the invention provides an invalid hoist comprising a chassis having a main support member on which a mast is supported and two side members extending forwardly of the main support member, the side members being swivellable by power operated means between a first position in which they extend from the main support member in parallel or substantially parallel spaced relationship and a second position in which they diverge as they extend forwardly from the main support member, the power operated means comprising an electrically powered actuator and a linkage arrangement which ensures that the side members are swivelled in opposite angular directions at equal angular rates of displacement by the actuator.

Preferably, the linkage arrangement comprises a first link connected to the main support member for pivotal movement about a first axis parallel to and equidistantly spaced from the swivel axes of the two side members and second and third links connected at first ends to the first link for pivotal movement relative thereto about second and third axes disposed on opposite sides of, and equidistantly spaced from, the first axis and connected at second ends to the two side members, respectively, for pivotal movement relative thereto about fourth and fifth axes spaced equidistantly from the first axis and also spaced equidistantly from the swivel axes of respective side members.

Preferably, the actuator is pivotally connected at opposite ends to the two side members, respectively, and in this case the fourth and fifth axes are preferably coincident with the pivot axes between opposite ends of the actuator and the two side members.

The invention will now be more particularly described, by way of example, with reference to the accompanying drawings, in which:

DESCRIPTION OF THE PREFERRED EMBODIMENTS

Figure 1:
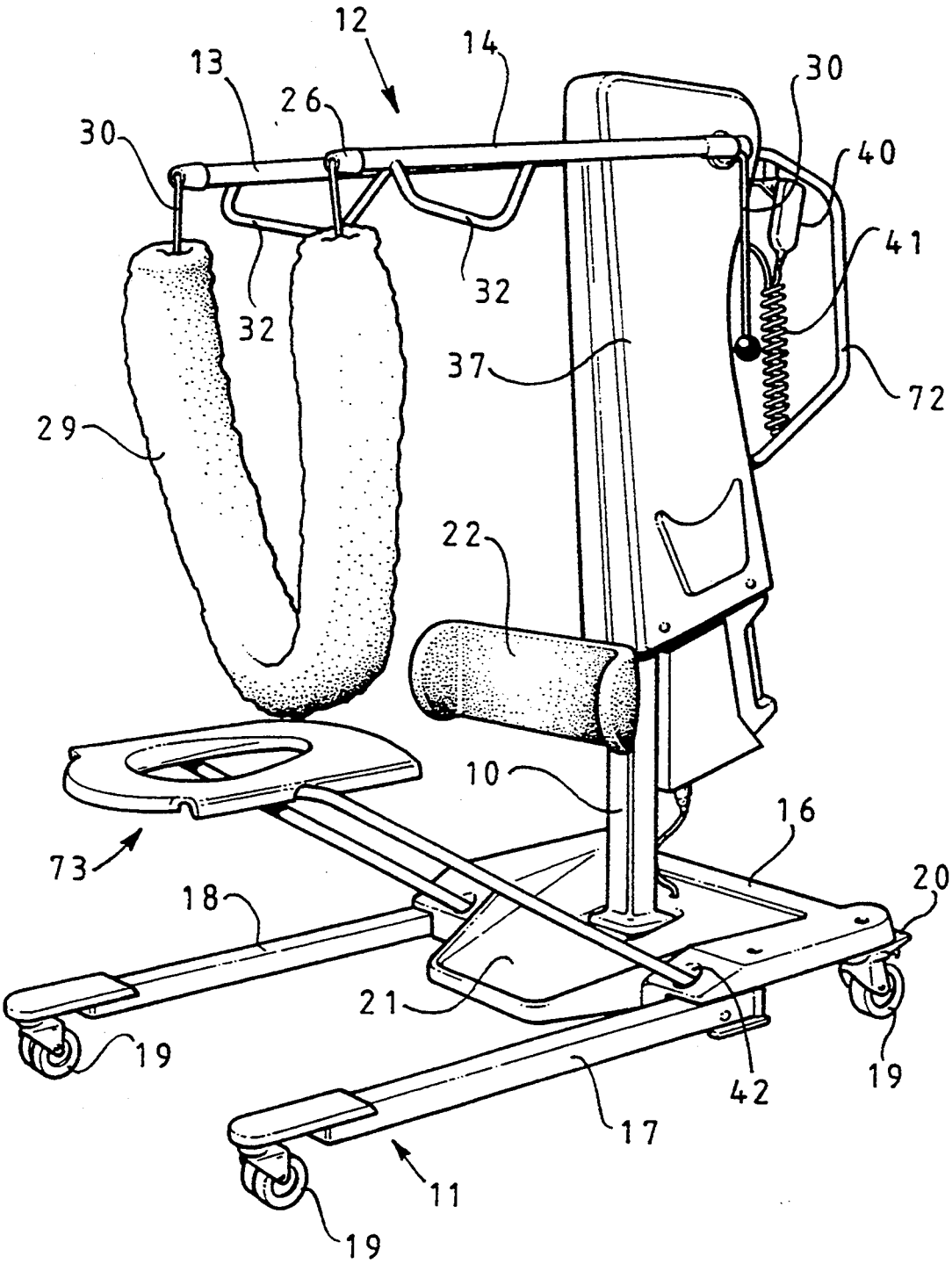
FIG. 1 is a perspective view of one embodiment of an invalid hoist according to the first aspect of the invention.
Figure 2:
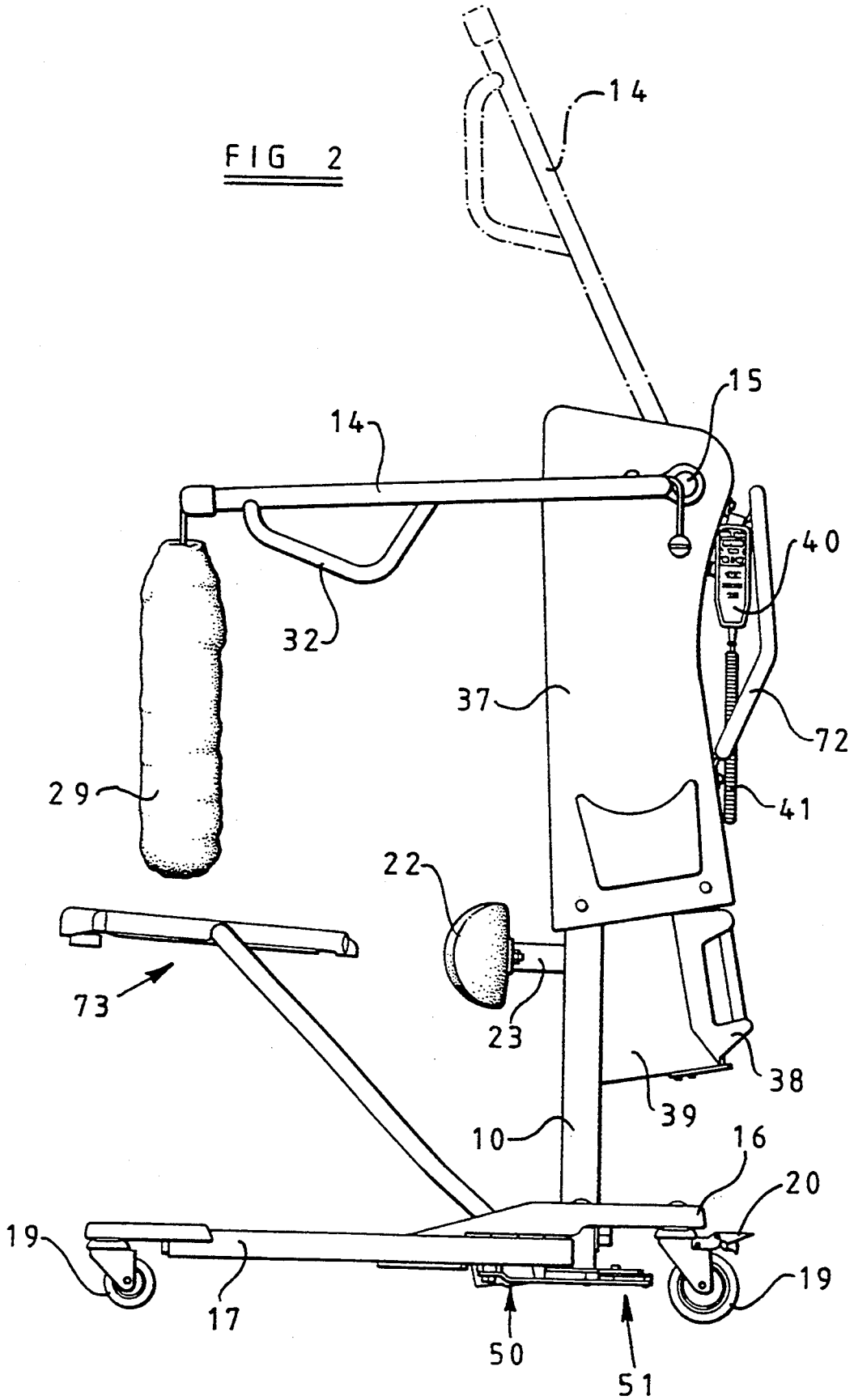
FIG. 2 is a side view of the invalid hoist shown in FIG. 1.
Figure 3:
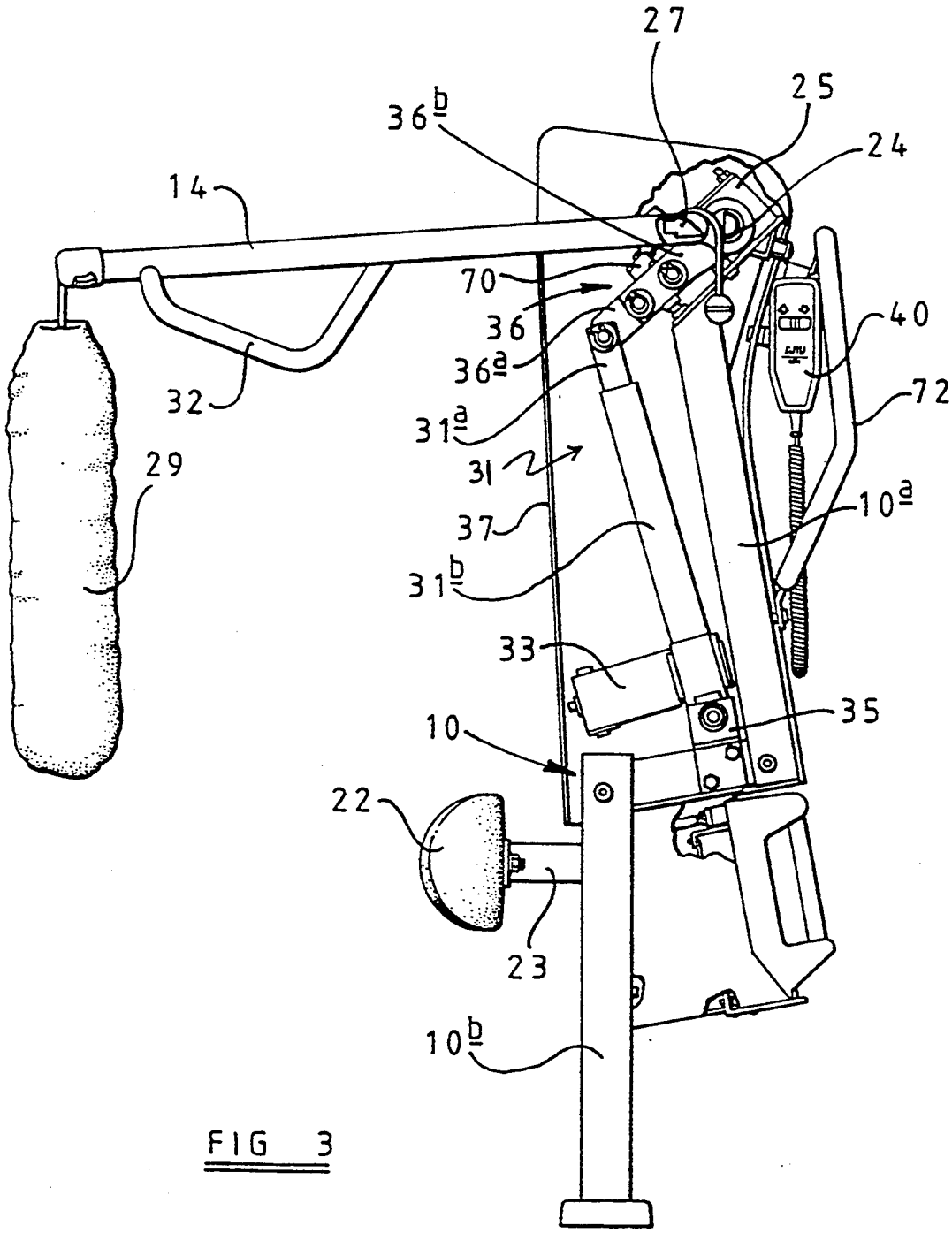
FIG. 3 is a side view of part of the invalid hoist of FIG. 1 with part of the housing enclosing the torque arm and actuator removed.
Figure 4:
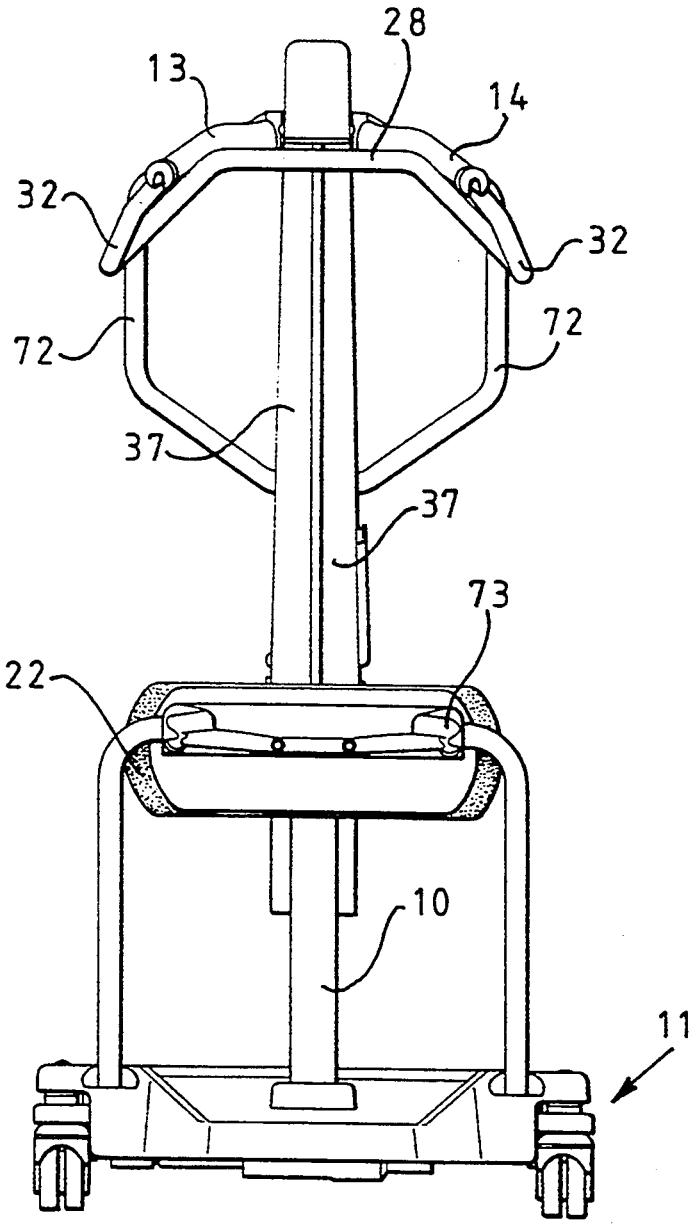
FIG. 4 is a front view of the invalid hoist shown in FIG. 1.
Figure 5:
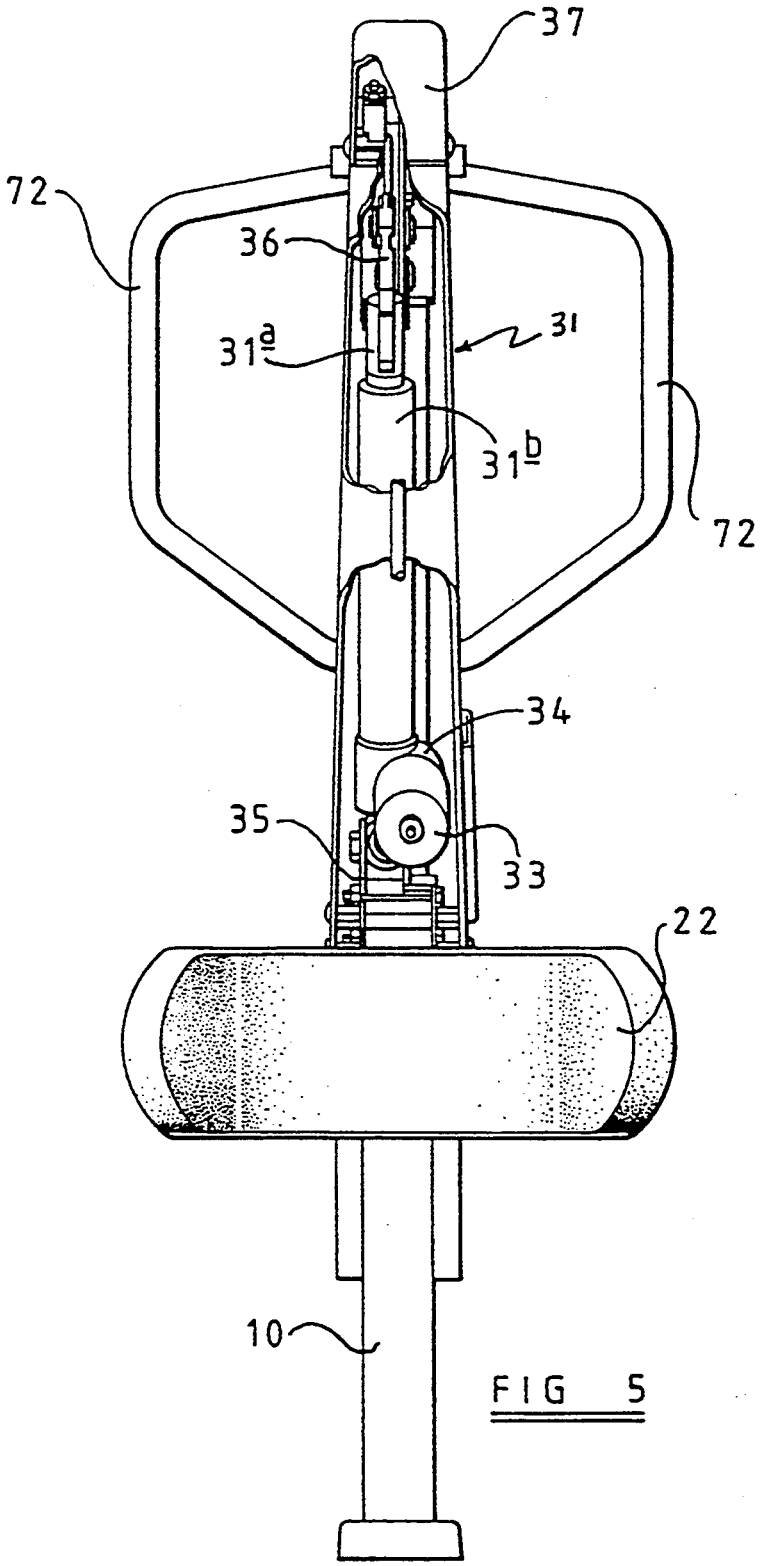
FIG. 5 is a front view of part of the invalid hoist shown in FIG. 1 with part of the housing enclosing the torque arm and actuator broken away.
Figure 6:
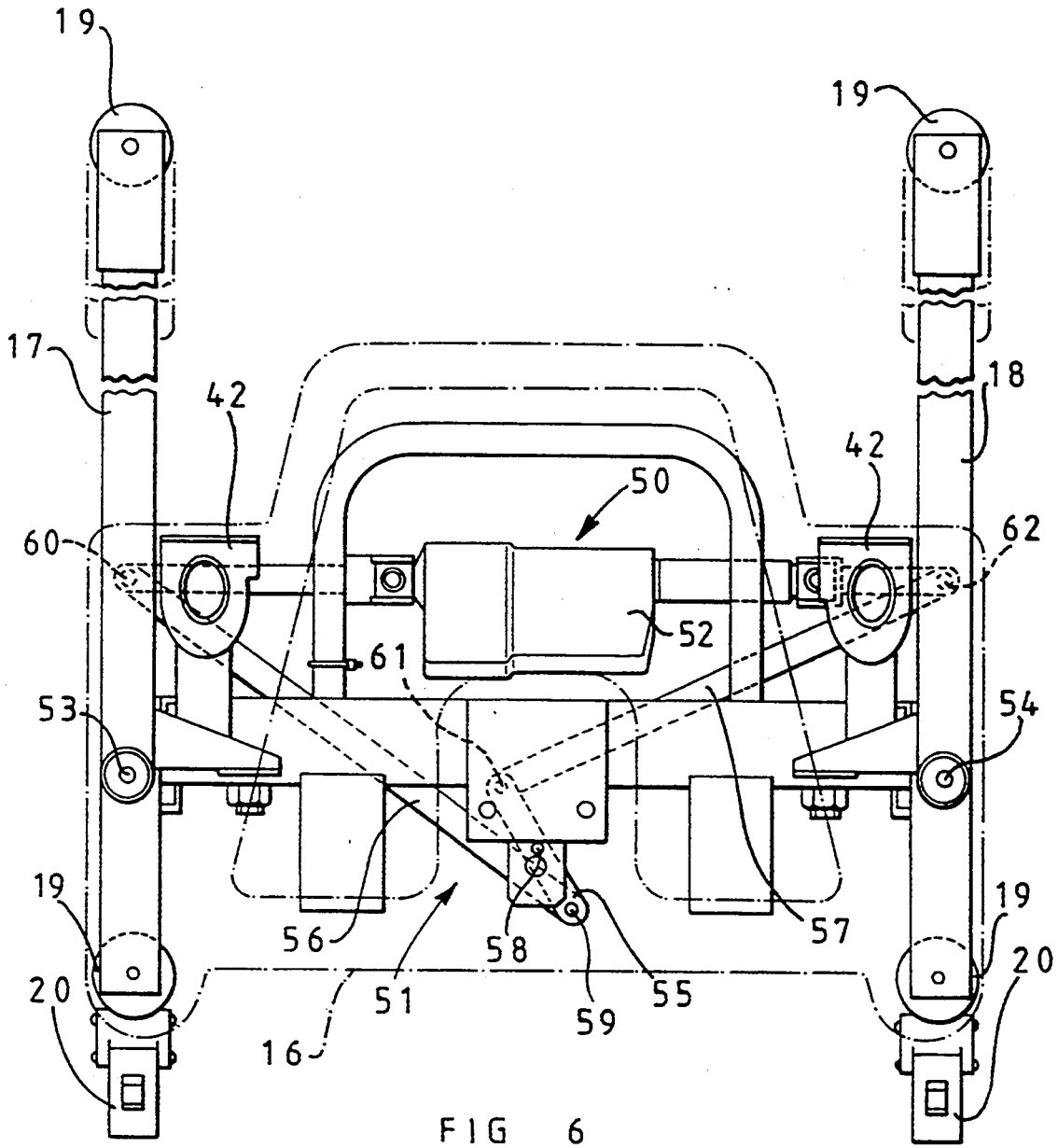
FIG. 6 is a plan view of part of the power operated chassis shown in FIG. 1.

Referring firstly to FIGS. 1 to 3 of the accompanying drawings, the invalid hoist shown therein is in the form of a standing aid for raising infirm and disabled persons from a sitting to a generally standing position.

The hoist comprises a mast 10 mounted on a mobile chassis 11 and a lifting member 12 having two lifting arms 13 and 14 supported at the upper end of the mast 10 for pivotable movement about a horizontal axis 15.

The chassis 11 comprises a main support member 16, to which the lower end of the mast 10 is secured, and two side members 17 and 18 which extend forwardly of the support member 16. The side members 17 and 18 are connected at their rearward ends to the main support member 16 by respective swivel connections 53 and 54 so that they can be spread apart at their forward ends to straddle a chair and so that they can be moved inwards to the position shown in FIG. 1 to allow the hoist to pass through a door opening.

The chassis 11 is provided with four castors 19, two on the support member 16 and one on each of the side members 17, 18. The two castors 19 on the main support member 16 are provided with foot operable brake levers 20 to hold the chassis 11 in a rest position.

A recessed footrest 21 is formed as an integral part of the support member 16 and projects forwards of the mast 10, and a knee abutment pad 22 is fixed by a bracket 23 to the front wall of the mast 10. If desired the pad 22 could be connected to the bracket for pivotable movement about a horizontal axis extending transversely of the hoist.

The mast 10 is of hollow square box section and is cranked rearwards (i.e. to the right as seen in FIG. 3) approximately midway between its upper and its lower ends so that the upper mast portion 10*a* is spaced rearwardly of the lower mast portion 10*b* for a purpose which will become apparent hereinafter. The upper mast portion 10*a* is also inclined forwardly at a small angle to the vertical.

The two lifting arms 13 and 14 are secured to opposite ends of a shaft 24 which is journalled for rotation about axis 15 in bearing blocks 25 at the upper end of the mast 10. The two ends of the shaft 24 are provided with flats (not shown) with which inner or rearward ends of the arms 13 and 14 can be slidably engaged before being secured in place by threaded bolts. The lifting arms 13 and 14 are hollow and define tubular guides. The forward end of each arm 13, 14 is fitted with a plastics ferrule 26 and a jam cleat 27 is fixed to and almost entirely housed within the rearward end of each guide 26. Also, the two arms 13 and 14 are interconnected by a cross member 28 which is shaped to form depending hand grips 32 at opposite ends.

As shown in FIGS. 1 to 3, a body sling 29 is attached to the lifting member 12. The sling 29 has a padded central part and two attachment cords 30. The cords 30 extend through respective arms 13, 14, which define laterally spaced attachment points, and are clamped in respective jam cleats 27.

The lifting arms 13 and 14 arm raised and lowered by an electrically powered actuator 31 which could, if necessary, be assisted during a raising operation and resisted during a lowering operation by a gas spring (not shown) arranged alongside the actuator 31. The actuator 31 is an electromechanical actuator having upper and lower telescopically mounted body parts 31*a* and 31*b*, respectively, a nut and threaded rod within the body parts, and a motor 33 which is secured to the lower body part 31*b* and which drives the threaded rod through a reduction gear box 34 to extend and retract the upper body part 31*a* relative to the lower body part 31*b*.

The lower body part 31*b* of the actuator 31 is pivotally connected at its lower end to a bracket 35 which is secured to the lower end of the upper mast portion 10*a*. The upper end of the upper body part 31*a* of the actuator 31 is pivotally connected to the outer or forward end of a torque arm 36 which is disposed between the bearing blocks 25 and which is secured, such as by welding, at its inner or rearward end to the shaft 24.

Hence, if the motor 33 is rotated in a sense to extend the actuator 31, the torque arm 36 will pivot upwardly about the axis 15 of the shaft 24 and this will in turn rotate the shaft clockwise as seen in FIGS. 2 and 3 to pivot the lifting arms 13 and 14 upwardly. If the motor 33 is rotated in an opposite direction to retract the actuator 31, the lifting arms 13 and 14 will pivot downwardly.

The torque arm 36 is formed in two parts 36*a* and 36*b* which are connected together for very limited free pivotable movement relative to one another. This allows the outer or forward part 36*a* to pivot downwards slightly with respect to the inner or rearward part 36*b* should one or both of the lifting arms 13 and 14 meet with an obstruction during a lowering operation of the arms 13 and 14. This slight pivotal motion of the outer part 36*a* of the torque arm 36 relative to the inner part 36*b* is sensed by a microswitch 70 fixed to the inner part 36*b* to cut off the power supply to the actuator 31 and thereby prevent injury to the user or operator of the hoist. A further microswitch can be provided to cut off the power supply to the actuator 31 when the lifting arms 13 and 14 reach an uppermost position (shown in broken lines in FIG. 2).

As shown in FIG. 3, a straight line connecting the pivot axis between the actuator 31 and the torque arm 36 to the axis of the shaft 24 is angularly spaced about the axis of the shaft 24 from the general longitudinal extent of the lifting member 12. This enables the actuator 31 to obtain a better leverage on the torque arm 36 over the range of movement of the lifting arms 13 and 14, which, as shown in FIG. 2, is from an angle just below the horizontal to an angle of about 60° above the horizontal.

By providing a separate torque arm 36, which is offset axially from each of the lifting arms 13 and 14, it is possible to enclose the actuator 31 and the torque arm 36 in a housing 37 thus improving the aesthetic appearance of the hoist and shielding both user and carer from points where parts of the body could become trapped.

A rechargeable battery pack 38 for powering the motor 33 is accommodated behind the lower mast portion 10*b* and is easily removable for recharging. Relays (not shown) for operating the motor 33 and a current limiting device (also not shown) to cut off the power supply to the motor 33 when the actuator 31 reaches its fully retracted position are provided in a compartment 39 also behind the lower mast portion 10*b*. The motor 33 may also have a speed control circuit to increase and decrease the speed of the motor gradually when the actuator is switched on and off.

A remote control device 40 for operating the motor 33 is connected to the relays by a flexible connecting wire 41.

Handles 72 are provided on the rear of the housing 37 so that the hoist can be moved by a carer.

In use, the hoist is wheeled up to a patient seated on a chair with the side members 17 and 18 of the chassis 11 spread apart and straddling the chair. The cords 30 of the sling 29 are released from the jam cleats 27 and the sling 29 is placed around the back of the seated patient below the patient's arms. The patient's feet are placed on the footrest 21 with the patient's knees against the knee abutment pad 22 and the patient's hands are placed on the hand grips 32. The slack is then taken out of the cords 30 and the latter are secured in respective jam cleats. The patient is then ready to be lifted to a generally standing position.

To lift the patient a carer or the patient operates the remote control device 40 to extend the actuator 31. This raises the lifting arms 13 and 14 from the position shown in full lines in FIG. 2 to that shown in broken lines in FIG. 2 to lift the patient to a generally standing position on the footrest 21.

The hoist is particularly useful in facilitating the toileting of disabled or infirm persons as a single carer can effortlessly lift the patient, remove outer clothing, lower underclothing, and lower the patient onto a toilet.

The hoist is provided with a detachable seat 73 which fits in sockets 42 in the support member 16 or in sockets (not shown) supported by the bracket 23 at opposite ends of the knee abutment pad 22. In either case, the seat may be fitted to the hoist after the patient has been raised to a generally standing position so that the patient may be lowered onto the seat and transported from one location to another in a seated position. The seat may have a central aperture so as to serve as a mobile commode.

The use of a separate torque arm and actuator, together if desirable with a gas spring, has application on hoists other than standing aids, e.g. on hoists which have a single lifting arm to raise and lower a patient supported in a full body support sling. In this case, however, it would be desirable to provide the single lifting arm with a bifurcated end for attachment to opposite ends of the shaft 24. The housing 37 could then be disposed within the bifurcated end of the single lifting arm.

The chassis 11 also includes an electrically powered actuator 50 to spread the side members 17 and 18 apart at their forward ends and to move them back again and a linkage arrangement 51 to ensure that the side members 17 and 18 are swivelled in opposite angular directions at equal angular rates of displacement by the actuator 50.

The actuator 50 is an electromechanical actuator similar to the actuator 31 and has two telescopically mounted body parts which are extendible and retractable relative to one another by a motor 52 and a screw and nut arrangement within the body parts.

The linkage arrangement 51 comprises three links 55, 56 and 57. The link 55 is shorter than the links 56 and 57 and is pivotally connected midway between its ends to the support member 16 for pivotal movement about a vertical axis 58 which is parallel to, and equidistantly spaced from, the axes of the swivel connections 53 and 54. The links 56 and 57 are of equal length. One end of the link 56 is pivotally connected to one end of the link 55 for relative movement about axis 59 and the other end of the link 56 is pivotally connected to the side member 17 for relative movement about axis 60 which is spaced forwardly of the swivel connection 53. One end of the link 57 is pivotally connected to the other end of the link 55 for relative movement about axis 61 and the other end of the link 57 is pivotally connected to the side member 18 for relative movement about axis 62. One end of the actuator 50 is pivotally connected to the side member 17 for relative movement about the axis 60 and the other end of the actuator 50 is pivotally connected to the side member 18 for relative movement about the axis 62.

It will be appreciated that extension of the actuator 50 will cause the side members 17 and 18 to swivel about swivel connections 53 and 54 and spread apart at their forward ends. Retraction of the actuator 50 will have the opposite effect.

The axes 59 and 61 are equidistantly spaced from the axis 58. The axes 60 and 62 are equidistantly spaced from the axes 59 and 61, respectively, and the axes 60 and 62 are equidistantly spaced from the axes of the swivel connections 53 and 54, respectively. With such an arrangement, it will be appreciated that the linkage arrangement 51 will ensure that the side members 17 and 18 are swivelled in opposite angular directions at equal rates of displacement by the actuator 50. Hence, the side members 17 and 18 will move apart at their forward ends by equal amounts when the actuator 50 is extended and will return to their original positions when the actuator 50 is retracted.

The actuator 50 can be operated by the same remote control device 40 that operates the actuator 31.

A chassis as described and incorporating the actuator 50 and linkage arrangement 51 could be used on any kind of invalid hoist to spread the side members apart.

The embodiment described above is given by way of example only and various modifications will be apparent to persons skilled in the art without departing from the scope of the invention as defined in the appended claims. For example, the lifting arms 13 and 14 could be cranked to allow the cords 30 to exit from the arms intermediate the ends of the arms. Also, the cords could extend through guides secured to the lifting arms instead of through the lifting arms themselves.

What I claim is:

1. An invalid hoist comprising a chassis having a main support member on which a mast is supported and two side members extending forwardly of the main support member, the side members being swivellable by power operated means between a first position in which they extend from the main support member in parallel or substantially parallel spaced relationship and a second position in which they diverge as they extend forwardly from the main support member, the power operated means comprising an electrically powered actuator and a linkage arrangement which ensures that the side members are swivelled in opposite angular directions at equal angular rates of displacement by the actuator, said linkage arrangement comprising a first link connected to the main support member for pivotal movement about a first axis parallel to and equidistantly spaced from the swivel axes of the two side members and second and third links connected at first ends to the first link for pivotal movement relative thereto about second and third axes disposed on opposite sides of, and equidistantly spaced from the first axis and connected at second ends to the two side members, respectively, for pivotal movement relative thereto about fourth and fifth axes spaced equidistantly from the first axis and also spaced equidistantly from the swivel axes of respective side members.

2. An invalid hoist as claimed in claim 1, wherein the actuator is pivotally connected at opposite ends to the two side members and the fourth and fifth axes are coincident with the pivot axes between opposite ends of the actuator and the two side members.

* * * * *